United States Patent [19]

Ramacciotti et al.

[11] 3,975,577

[45] Aug. 17, 1976

[54] COMPOUND MELTABLE ELECTRODE FOR MANUFACTURING METAL ARTICLES BY REMELTING UNDER ELECTROSLAG

[75] Inventors: Aldo Ramacciotti; Eugenio Repetto, both of Genoa; Paolo Sommovigo, La Spezia, all of Italy

[73] Assignee: Centro Sperimentale Metallurgico S.p.A., Rome, Italy

[22] Filed: May 13, 1975

[21] Appl. No.: 576,994

[30] Foreign Application Priority Data

June 4, 1974 Italy ..... 51379/74

[52] U.S. Cl. ..... 13/18

[51] Int. Cl.[2] ..... H05B 7/07

[58] Field of Search ..... 13/18, 9

[56] References Cited

UNITED STATES PATENTS

| | | | |
|---|---|---|---|
| 1,312,255 | 8/1919 | King | 13/18 UX |
| 2,003,653 | 6/1935 | Miguet | 13/18 X |
| 3,465,085 | 9/1969 | Yonemochi | 13/18 |
| 3,604,826 | 9/1971 | Muller et al. | 13/18 |

*Primary Examiner*—R. N. Envall, Jr.
*Attorney, Agent, or Firm*—Young & Thompson

[57] ABSTRACT

A compound meltable electrode for manufacturing metal articles by remelting under electroslag, consisting of a first solid metal meltable element, a second meltable element consisting of at least one of the substances selected from the group comprising metal powder, a binder, and slag, and a third metal meltable element containing and reinforcing said meltable layer.

9 Claims, 7 Drawing Figures

COMPOUND MELTABLE ELECTRODE FOR MANUFACTURING METAL ARTICLES BY REMELTING UNDER ELECTROSLAG

The present invention relates to a compound meltable electrode for manufacturing metal articles by remelting under electroslag, and more precisely an electrode consisting essentially of metal powder, particularly suitable for the manufacture of large ingots for forging or also for the supply of metal on a metal article to be coated.

Several methods and several devices exist for manufacturing metal articles with the technique of re-melting under electroslag. Some of these methods have been disclosed in U.S. Pat. No. 3,905,803, owned by Centro Sperimentale Metallurgico, and in this patent a process was proposed for manufacturing metal alloys and the associated apparatus, the latter consisting essentially of a metal tube closed at its bottom, into which a limited amount of metal powder having a suitable composition is introduced. The metal powder will locate itself in the tube forming a layer having relatively little height; one part of said layer, due to the heat developed during the melting operation, sinters forming a support element for the remaining layer of metal powder, once the closure element at the base of the tube is melted away. While the melting proceeds, the sintered layer moves, rendering possible the correct operation of the process; the metal powder is continuously added, so as to replace the melting sintered portion, maintaining almost constant the total height of the layer of powder existing inside the metal tube. This electrode system provided excellent results, however it was not possible to increase the diameter thereof beyond a certain value as otherwise the sintered layer becomes too weak to support the weight of the superposed non sintered powder.

In copending application Ser. No. 514,260, filed Oct. 11, 1974, there is provided a further forward step in the art of remelting under electroslag, by suggesting a tubular electrode consisting of two concentric tubes, into the annular space between said tubes being introduced the metal powder, in a way quite similar to that described in the above-identified patent. By this new electrode the sole drawback of the other electrode as disclosed in the copending application is removed, i.e., the necessarily relatively small diameter of the electrode, as an electrode is obtained having such a thickness as to avoid the breakage of the layer of powder, but extended through a length equalling the circumference of the annular ring as defined by the two concentric tubes. By this electrode, furthermore, it is possible to effect in an extremely simple way, the coating of a central metal core having whatsoever diameter, with one or more layers of metal alloy having whatsoever composition.

Recently a patent application has been published in France No. 7307458, with Japanese priority of Mar. 6, 1972, Ser. No. 22290-72 in the name of Mitsubishi Jukogyo K. K., wherein another electrode for remelting under electroslag is described and claimed, consisting of a hollow body having any desired cross section, "the inside of which is filled with metal powder" said metal powder being preferably rendered compact within the body so as to sinter more easily. Such a type of electrode, even if apparently very attractive, has a certain number of drawbacks, such as for instance the greater cost due to the compacting operation, the difficulty of using simultaneously several electrodes for manufacturing containers or large diameter tubes, said difficulty being connected to the difficulties of the plants necessary for holding simultaneously a large number of electrodes and for feeding the current thereto, to the fact that said electrodes having necessarily small transverse dimensions can be easily bent and thereby they can contact one another or contact the ingot mold, with the consequent interruption of the remelting process, and to the fact that in said electrodes having small transverse dimensions the metal powders cannot be easily and economically introduced and rendered compact.

The present invention aims to remove the aforesaid drawbacks offered by the preceding electrodes, providing an electrode having a simpler and more reliable operation, with a reduced weight and very economically produced. According to the present invention, a metal body having a suitable chemical composition is coated externally, or internally if said body is a hollow body, with a supporting reinforcement which can be suitably formed by one or more layers of metal net held by means, known per se, spaced apart from the inner or outer wall of said metal body, said layer or layers of metal net being subsequently embedded in a layer, or skin, consisting of metal powder having such a composition that together with the material of the "tube" and of the "net" it will supply to the melted unit the desired composition, of a binder for instance pitch or other binder preferably easily reduced to coke, and of slag having such a composition as to be suitable for the remelting process under electroslag. Thus a compound electrode will be obtained wherein a solid metal part acts as a support for the metal powder and as current carrier, while a non solid metal part, namely the powder acts as main supply element of the metal to the remelting process. The metal net serves for forming such a reinforcement as to render unnecessary a further support element, such as for instance a further tube, as disclosed in the above-identified copending application and, together with the binder, serves to render compact and mechanically strong the layer of metal powder.

In another embodiment of the present invention, the support reinforcement can consist simply of a relatively thin sheet located around the layer of the metal powder-binder-slag mixture. In a further embodiment of the present invention, into a metal hollow body, serving as a support and a current carrier, a support reinforcement is introduced, suitably consisting of a spiral wound metal net, or of a group of metal solid bars or pipes, and then the internal space of the hollow metal body remaining between said hollow body and said internal support reinforcement will be filled with a metered mixture of metal powder, binder or slag. It will be possible advantageously to add to this mixture a certain amount of particulate metal scrap, such as for instance, scraps of wire or of rods, of sheet and the like, having reduced dimensions.

If as internal reinforcement a tube will be used, the latter can also consist of a net wound in the shape of a cylinder or of a pipe having a certain number of holes and in this case this reinforcement, besides forming a support for the metal powder can serve for rendering easy the heat transmission inside the mass of powder, as well as for rendering easy the exhaust of the gas and vapours developed during the binder baking process.

The electrodes according to the present invention, besides being more economical than the other electrodes known in the art, and of being prepared more easily and more simply used, have a further advantage in that they do not need to be closed at their ends, and this forms, for the evident saving of time in their preparation, a further economical advantage.

Another substantial advantage of the electrodes according to the present invention, when the electrode consists of a metal tube internally or externally coated with a layer of metal powder, will be obtained when the electrode will be used for coating a metal cylinder. In this case, owing to the continuity of the section of the electrode, there is a uniform distribution of both the heat developed by the passage of the current through the layer of melted slag, and of the magnetic fields in the melted metal bath, obtaining thus a particularly uniform distribution of the metal supplied to the surface of the cylinder, without having recourse to the complex mechanical systems for moving the electrodes along a circular path, as is necessary with the electrodes known previously in the art.

Another advantage can be found in that, due to the reinforcement, the electrodes according to the present invention are remarkably strong and require no particular care during their transport and storage, even if they are of the type in which the metal powder-binder mixture is located outside the solid supporting metal body.

A further advantage not less important than the above mentioned advantages, consists in that said "electrodes" can be assembled separately from the remelting plant, and further the equipment for delivering the slag into the melted bath and of the metal powder as used, in the known processes, is dispensed with.

The present invention will be now described more precisely in relation to certain embodiments, reported only by way of non limitative example, shown in the attached sheets of drawings, wherein.

Figure 1:
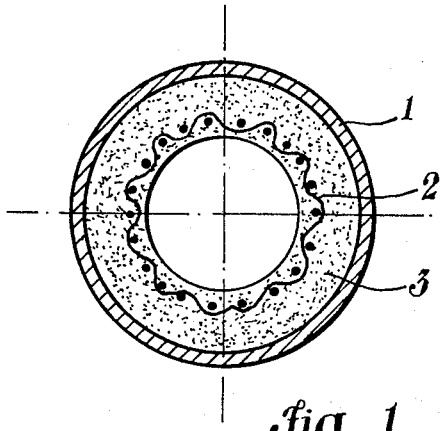
FIG. 1 is a sectional view of an electrode wherein the solid metal support is external and the metal net is embedded into the metal powder-binder-slag mixture.
Figure 2:
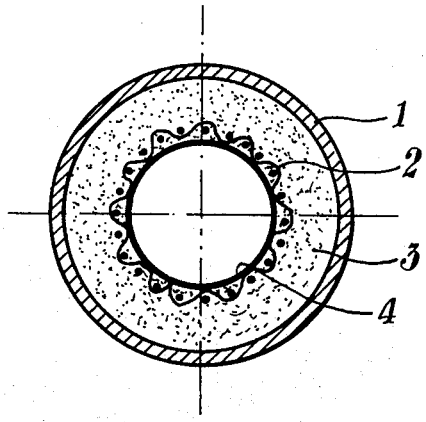
FIG. 2 is a sectional view of another embodiment of an electrode according to the present invention, wherein the solid metal support is external, and the metal net rests on the layer of metal powder.

With reference to FIG. 1 into a solid metal element 1 acting both as main support and as current carrier, consisting of a metal tube, is inserted a pack consisting of one or more layers of metal net 2 serving as a further support and as a reinforcing member for a layer 3 of metal powder mixed with a binder, for instance and in a non limitative way, pitch or other material capable of being coked and of slag of a known type. Alternatively, the layer of metal powder 3 mixed with the binder and the slag can be located, as shown in FIG. 2, directly to contact the metal tube 1, while the metal net 3 is simply arranged to rest on the free surface of the layer of metal powder; thus the metal net can be advantageously let into a further layer of slag 4 which can project beyond the metal net inwards of the so-formed electrode.

Figure 3:
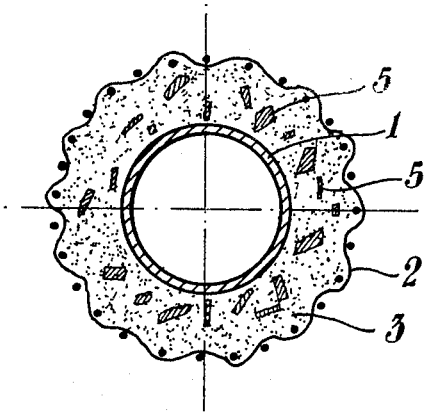
FIG. 3 is a sectional view of a further embodiment of an electrode according to the present invention, wherein the solid metal support is internal.
Figure 4:
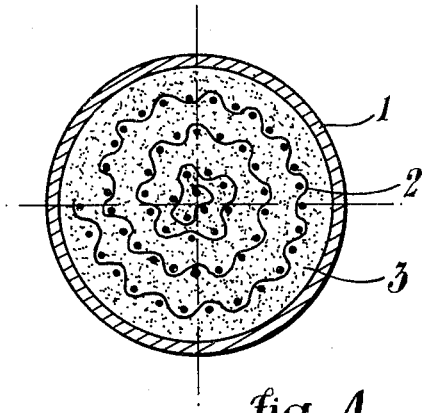
FIG. 4 is a sectional view of another electrode according to the present invention, wherein the metal powder fills an external metal tube, and as a reinforcement of the column of metal powder use is made of a spiral wound metal net.
Figure 5:
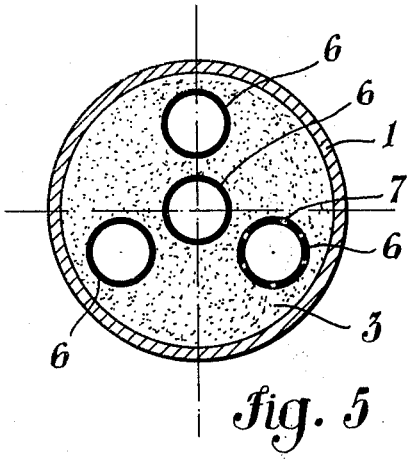
FIG. 5 is another embodiment of the electrode of FIG. 4, however wherein the reinforcing element consists of a set of metal tubes.
Figure 6:
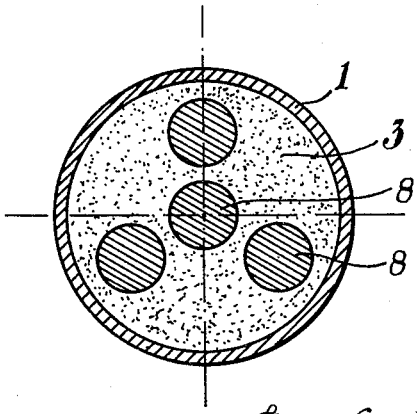
FIG. 6 is a further embodiment of the electrode of FIG. 4, however wherein the reinforcing element consists of a set of solid metal bars.

In the embodiment shown in FIG. 3, the main support element consists of a metal tube 1 on the outer surface of which is applied a layer of mixture of the metal powder with the binder and the slag, while the reinforcing layer of metal net 2 is located outside of the layer of metal powder 3, or it can be let into said layer. In this embodiment, into the layer of metal powder are let scraps 5 of wire or of metal sheet. Said scraps, of course must not be excessively massive. FIGS. 4, 5 and 6 show other embodiments, rather similar to one another, of an electrode according to the present invention, in which a solid metal outer element 1, in this case consisting of a metal tube, will be filled with the mixture 3 of metal powder, binder and slag, and the reinforcing element consists of a spiral wound metal net 2, extending longitudinally throughout the length of the electrode (FIG. 4) or of a set of tubes 6 through which can also be provided holes (FIG. 5), or also of solid metal bars 8 (FIG. 6).

Figure 7:
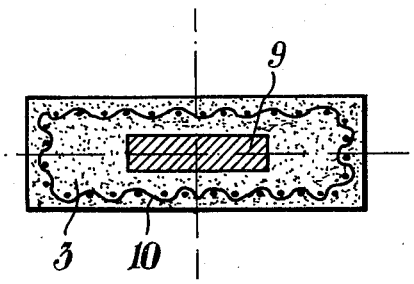
FIG. 7 is a last example of embodiment of an electrode according to the present invention, shown in sectional view, wherein the main supporting element consists of a solid metal bar.

In a further embodiment of the electrodes according to this invention, shown in FIG. 7, the main support element consists of a solid metal bar 9 around which is located the layer 3 of metal powder-binder-slag mixture. Suitably, about said layer 3 of metal powder is arranged a reinforcing element 10 which can be formed by a metal net let into the surface zone of the layer 3, or of a thin metal sheet, directly resting on the surface of said layer. Of course, the electrodes according to the present invention can be so shaped as to render easy to connect, for instance by welding, a new electrode to an electrode is already almost melted, so as to be able to melt as many electrodes as desired, sequentially and without having to discontinue the melting process.

Said binder can be replaced at least partially by slagging material.

Having thus described the present invention, what is claimed is:

1. A compound meltable electrode for manufacturing metal articles by remelting under electroslag, characterized in consisting of a meltable metal tube on the internal surface of which is arranged a meltable layer consisting of metal powder and a binder and a slag, into the thickness of said meltable layer being let a reinforcing meltable metal element, consisting of at least one layer of metal net.

2. A compound meltable electrode for manufacturing metal articles by remelting under electroslag, characterized in consisting of a meltable metal tube on the inner surface of which is located a meltable layer consisting of metal powder and a binder and of a slag, on the free surface said layer being arranged a meltable reinforcing element consisting of a metal net, on said reinforcing element, a thin slag layer being located.

3. A compound meltable electrode for manufacturing metal articles by remelting under electroslag, characterized in consisting of a meltable metal tube on the outer surface of which is located a meltable layer consisting of metal powder and a binder and a slag, said meltable layer being provided with a meltable reinforcing element consisting of a metal net.

4. A compound meltable electrode for manufacturing metal articles be remelting under electroslag, characterized in that it consists of a metal meltable bar on the surface of which is located a meltable layer consisting of metal powder and a binder and slag, said meltable layer being provided with a meltable reinforcing element consisting of a metal net.

5. A compound meltable metallic electrode to be used in electroslag remelting apparatus to manufacture metal articles, comprising in combination a plurality of metal layers, a first layer being a solid metal element, a second layer being a metal powder and a third layer being a solid reinforcing element for said second layer.

6. An electrode as claimed in claim 5, said second layer containing also a binder and a slag-forming substance.

7. A compound meltable metallic electrode to be used in electroslag remelting apparatus to manufacture metal articles, comprising a meltable metal tube filled with a meltable metal powder and a binder and a slag, and a reinforcing element for sustaining said meltable metal powder and binder and slag in said tube.

8. An electrode as claimed in claim 5, in which said reinforcing element is a metal net.

9. An electrode as claimed in claim 5, and metal scraps in said layer of metal powder, said scraps having a maximum dimension which is less than 20 mm.

* * * * *